United States Patent [19]

Cairns

[11] 4,371,564

[45] Feb. 1, 1983

[54] PRODUCTION OF POROUS DIAPHRAGM FOR ELECTROLYTIC CELL

[75] Inventor: John F. Cairns, Frodsham, England

[73] Assignee: Imperial Chemical Industries Limited, London, England

[21] Appl. No.: 265,221

[22] Filed: May 19, 1981

[30] Foreign Application Priority Data

May 30, 1980 [GB] United Kingdom ..... 8017687

[51] Int. Cl.[3] ..... B05D 3/06

[52] U.S. Cl. ..... 427/35; 427/36; 427/44

[58] Field of Search ..... 427/35, 36, 40, 44

[56] References Cited

U.S. PATENT DOCUMENTS

| | | | |
|---|---|---|---|
| 3,666,693 | 5/1972 | Chapiro et al. | 427/36 |
| 3,944,709 | 3/1976 | Levy | 427/40 |
| 4,113,922 | 9/1978 | D'Agostino et al. | 429/33 |
| 4,189,369 | 2/1980 | Fang | 204/296 |

FOREIGN PATENT DOCUMENTS

| | | |
|---|---|---|
| 2322638 | 4/1977 | France . |
| 1526843 | 10/1978 | United Kingdom . |

OTHER PUBLICATIONS

Chem. Abstracts, vol. 83, 123307t, 1975.

*Primary Examiner*—John H. Newsome
*Attorney, Agent, or Firm*—Cushman, Darby & Cushman

[57] ABSTRACT

A process for the production of a porous diaphragm suitable for use in an electrolytic cell, particularly a chlor-alkali cell, characterized in that the process comprises irradiating a porous shaped article of an organic polymeric material, for example, a sheet of a fluoropolymer, with high energy radiation, the irradiation being effected in the presence of, or the irradiated shaped article being subsequently contacted with, a reactant selected from ammonia, carbon monoxide and phosgene, and the sheet preferably being subsequently contacted with an aqueous alkaline solution.

14 Claims, No Drawings

PRODUCTION OF POROUS DIAPHRAGM FOR ELECTROLYTIC CELL

This invention relates to a process for the production of a porous diaphragm suitable for use in an electrolytic cell.

Electrolytic cells comprising an anode, or a plurality of anodes, and a cathode, or a plurality of cathodes, with adjacent anodes and cathodes separated by a porous diaphragm, are used on a large scale in industry. Such electrolytic cells are used for example in the production of chlorine and aqueous alkali metal hydroxide solution by the electrolysis of aqueous alkali metal chloride solution, e.g. in the production of chlorine and aqueous sodium hydroxide solution by the electrolysis of aqueous sodium chloride solution. In such electrolyses the aqueous alkali metal chloride solution is charged to the anode compartments of the cell, chlorine is evolved at the anodes, alkali metal ions are transported through the diaphragm by the flow of the alkali metal chloride solution and in the cathode compartments react with the hydroxyl ions formed by electrolysis of water thereby forming alkali metal hydroxide. Hydrogen is also evolved in the cathode compartments, and the alkali metal hydroxide is recovered in the form of an aqueous solution also containing alkali metal chloride.

For many years the porous diaphragms which have been used commercially in such electrolytic cells have been made of asbestos. The use of asbestos however suffers from certain disadvantages. For example, asbestos swells in use and it is necessary to provide a substantial gap between each anode and adjacent cathode in order to accommodate the swollen asbestos diaphragm with the result that the energy utilised in the electrolysis is greater than would be the case if only a small anode-cathode gap were to be used. The use of asbestos also suffers from the disadvantage that it is toxic and must be handled with care, and asbestos fibre contamination of the products of electrolysis must be avoided.

In recent years a number of proposals have been made to replace asbestos diaphragms in electrolytic cells by porous diaphragms made of organic polymeric materials, particularly by diaphragms made of fluorine-containing organic polymeric materials, in order to overcome the aforementioned disadvantages of asbestos diaphragms. Fluorine-containing organic polymeric materials are favoured in view of their resistance to degradation by the environments encountered in electrolytic cells, e.g. chlorine and aqueous alkali metal hydroxide solution in chlor-alkali cells. For example, it has been proposed in U.K. Pat. No. 1,081,046 to produce a porous diaphragm by forming a sheet of polytetrafluoroethylene and a solid particulate additive, for example starch or calcium carbonate, and subsequently to remove the solid particulate additive from the sheet. In U.K. Pat. No. 1,522,605 it has been proposed to form a porous diaphragm of a fluorine-containing polymeric material by introducing an electrically-conducting spinning liquid comprising the polymeric material dispersed in a suitable liquid medium into an electric field whereby fibres are drawn from the liquid onto an electrode and the fibres are collected in the form of a sheet or mat which is suitable for use as a porous diaphragm. In U.K. Pat. No. 1,355,373 there is described a porous polymeric material containing units derived from tetrafluoroethylene, the material having a microstructure characterised by nodes interconnected by fibrils. This latter material may be made by a process in which a shaped article of the polymer is formed by a paste-forming extrusion technique, removing lubricant from the article, and stretching the article at an elevated temperature and at a rate exceeding 10% per second of its original length. The use of this latter porous polymeric material as a porous diaphragm in an electrolytic cell is described and claimed in U.K. Pat. No. 1,503,915.

Porous diaphragms made of fluorine-containing organic polymeric materials are not readily "wetted" by the aqueous electrolyte in the cell with the result that in order to induce the electrolyte to flow through the diaphragm during start-up of the electrolytic cell it may be necessary to pre-treat the diaphragm. Furthermore, on prolonged use of the diaphragm in an electrolytic cell the permeability of the diaphragm to the liquid electrolyte may tend to decrease and the pores of the diaphragm may tend to become blocked by the gaseous products of electrolysis. Eventually, the permeability of the porous diaphragm may become so low that the diaphragm is no longer usable.

The problem associated with the start-up of the electrolytic cell, and with the decrease in permeability of the diaphragm with time may be overcome by including a suitable surfactant in the electrolyte which is charged to the cell. However, the use of a surfactant suffers from serious disadvantages in that during use of the cell the surfactant is inevitably carried through the diaphragm and is incorporated into the liquid products of electrolysis and leads to serious difficulties in the subsequent processing of these products. For example, where the products of electrolysis include an aqueous solution of alkali metal hydroxide containing alkali metal chloride it is necessary to remove the chloride from the solution by concentrating the solution and crystallising the chloride, and the presence of a surfactant in the solution leads to unacceptable foaming during the concentration. Also, the contamination of the alkali metal hydroxide solution by surfactant may be unacceptable for many uses of the solution.

There have been a number of proposals to improve the "wettability" of porous diaphragms of organic polymeric materials in order to prolong the active lives of the diaphragms. For example, in U.K. Pat. No. 1,081,046 there is described the incorporation into the material of a particulate inorganic filler which is resistant to the environment encountered in the electrolytic cell. Particulate inorganic fillers which are described include barium sulphate, titanium dioxide, and amphibole and serpentine forms of asbestos. The incorporation of such particulate inorganic fillers is also described in U.K. Pat. No. 1,522,605. In U.K. Pat. No. 1,503,915 there is described the incorporation of a filler into a diaphragm having a microstructure of nodes interconnected by fibrils at a stage subsequent to the preparation of the diaphragm by immersing the diaphragm in a suspension of the filler in a liquid medium or by impregnating the diaphragm with a solution of a hydrolysable precursor of the filler and subsequently hydrolysing the precursor to produce the filler.

All of the aforementioned methods do result in an improved "wettability" of the diaphragm by the electrolyte and an increase in the active life of the diaphragm before the permeability of the diaphragm reaches an unacceptably low level. However, the filler may gradually be lost during use of the diaphragm and the active life of the diaphragm may still not be as great as may be desired. It is desirable to be able to produce a diaphragm which has a longer active life and which thus needs to be replaced even less frequently than is presently necessary with the diaphragms which have been proposed hitherto.

The present invention provides a process for producing a porous diaphragm which has a particularly long active life and which remains permeable to the electrolyte even on prolonged use in an electrolytic cell.

According to the present invention there is provided a process for the production of a porous diaphragm suitable for use in an electrolytic cell characterised in that the process comprises irradiating a porous shaped article of an organic polymeric material with high energy radiation, the irradiation being effected in the presence of, or the irradiated shaped article being subsequently contacted with, a reactant selected from ammonia, carbon monoxide or phosgene.

The shaped article of organic polymeric material desirably has a form which, without further shaping, makes it suitable for use as a diaphragm in an electrolytic cell, and although there is no limitation on the precise shape we find that the article may most conveniently be in the form of a sheet as a sheet is a particularly suitable shape for irradiation in the process of the invention and for subsequent installation in an electrolytic cell without further modification. The sheet may suitably have a thickness in the range 0.1 to 3 mm.

The process of the invention is not limited to use with a porous shaped article of an organic polymeric material made by any particular method. Thus, for example, the shaped article may be made by any of the methods described in the aforementioned U.K. Pat. Nos. 1,081,046, 1,522,605 and 1,355,373, although a preferred porous shaped article is one having a microstructure of nodes interconnected by fibrils of the type described in the latter patent. Porous shaped articles of organic polymeric material made by other methods may be used in the process of the invention provided that the articles have characteristics of, for example shape and porosity, which make them suitable, after treatment in the process of the invention, for use as a diaphragm in an electrolytic cell.

The organic polymeric material used in the process of the invention is desirably a fluorine-containing organic polymeric material as such materials are generally more resistant to degradation by the corrosive conditions encountered in electrolytic cells, especially in cells for the electrolysis of aqueous alkali metal chloride solutions, than are non-fluorine-containing organic polymeric materials.

The fluorine-containing organic polymeric material is itself desirably chosen to be chemically resistant to the conditions prevailing in the electrolytic cell in which the diaphragm is to be used. The fluorine-containing organic polymeric material may contain halogen other than fluorine, e.g. chlorine, for example it may be poly(-chlorotrifluoroethylene); it may contain carbon-hydrogen bonds, for example it may be poly(vinylidene fluoride); or it may be a perfluoropolymer, for example it may be polytetrafluoroethylene, a copolymer of tetrafluoroethylene and hexafluoropropylene, or it may be a fluorinated ethylene-propylene copolymer. A perfluoropolymer is preferred where the diaphragm is to be used in an electrolytic cell for the electrolysis of aqueous alkali metal chloride solution as perfluoropolymers are particularly resistant to degradation by the corrosive conditions prevailing in such a cell.

The shaped article suitably has a porosity such that the voids in the article comprise from 40% to 90% of the total volume of the article including voids, preferably 60% to 80%.

In the process of the present invention the porous shaped article is irradiated with high energy radiation, by which we mean that the shaped article is irradiated with radiation having an energy in excess of 15 ev. Suitable forms of radiation include $\gamma$-rays, especially $Co^{60}$ $\gamma$-rays, electron beams and high energy plasmas. The amount of high energy radiation with which the porous shaped article is irradiated has an effect on the extent to which the diaphragm is rendered "wettable" by an electrolyte and on the extent of the active life of the diaphragm produced by the process of the invention. It is preferred that the shaped article be irradiated with at least 0.1 M Rad of radiation, preferably at least 0.5 M Rad. The time for which the shaped article is to be irradiated in the process of the invention will of course depend on the strength of the source of radiation and on the amount of radiation which it is desired should be used in the process. In general irradiation will be effected for a period of time in the range 1 to 20 hours at dose rates of 0.1 to 0.6 M Rads/hour.

The irradiation step in the process of the invention is desirably carried out in the substantial absence of oxygen as the presence of oxygen may lead to degradation of the organic polymeric material and loss of mechanical strength of the material. The irradiation step may be carried out in the presence of one or more of the aforementioned reactants, ammonia, carbon monoxide or phosgene, or the irradiated shaped article may be contacted with the reactant subsequent to the irradiation step.

Where the irradiation is effected in the absence of the reactant the irradiation is desirably effected in a vacuum, in a suitably shaped vessel, and after the irradiation has been effected the shaped article is contacted with the reactant, by allowing the reactant to enter the vessel. The time for which contact is effected subsequent to irradiation may be very short, for example, as short as 10 seconds, although the contact time may be longer. In general the contact time will not be in excess of 1 hour. At ambient temperature the reactants are gaseous and it is convenient to effect contact between the irradiated shaped article and gaseous reactant, or effect the irradiation in the presence of the gaseous reactant at a gaseous reactant pressure in the range for example of 0.1 atmosphere to 1 atmosphere. However, if desired, gaseous reactant at a pressure above atmospheric may be used.

Ammonia is the most preferred reactant on account of the very long active life of the diaphragm produced when ammonia is used in the process of the invention.

Irradiation may suitably be effected at ambient temperature, although temperatures above ambient may be used.

The irradiation may be effected in any suitably shaped vessel. For example, where the porous shaped article is in the form of a sheet it may be rolled into a cylindrical form and the article may be irradiated in a tubular vessel, which may be of glass.

The irradiated shaped article, after contact with the reactant has been effected, is desirably heated in the presence of the reactant, e.g. to a temperature of up to 150° C., in order to quench active free radicals in the shaped article. The shaped article may then be cooled to ambient temperature before contact with an oxygen-containing atmosphere is effected.

The shaped article which has been irradiated and contacted with the reactant as hereinbefore described may itself be suitable for use as a porous diaphragm in an electrolytic cell. However, where it is desired to produce a porous diaphragm which remains permeable to electrolyte even after especially prolonged use in an electrolytic cell it is desirable, before the article is used as a diaphragm in an electrolytic cell, to effect the further step of contacting the shaped article with a liquid alkaline solution. In order to assist penetration of the liquid alkaline solution into the porous shaped article it is also desirable, before contacting the shaped article with the liquid alkaline solution, to contact the shaped article with a liquid medium which is very readily able to wet the shaped article and thereafter to contact the shaped article with the liquid alkaline solution. Suitable liquid media for this purpose include lower alcohols, e.g. methanol, and aqueous solutions containing an alcohol, and aqueous solutions containing a surfactant, e.g. an aqueous solution of a fluorochemical surfactant. For example, the shaped article may be contacted with an aqueous solution of a surfactant, dried, and then contacted with the aqueous alkaline solution.

The liquid alkaline solution may be an aqueous solution of an alkali metal hydroxide, e.g. an aqueous solution of sodium hydroxide.

Contact between the shaped article and the alkaline solution may be effected during use of the shaped article as a diaphragm in an electrolytic cell in the case where such an alkaline solution is one of the products of electrolysis, for example in the case where the shaped article is to be used as a diaphragm in an electrolytic cell for the production of chlorine and aqueous alkali metal hydroxide solution by the electrolysis of aqueous alkali metal chloride solution.

Better performance of the shaped article as a diaphragm may be obtained, however, where contact of the shaped article with the alkaline solution is effected prior to use of the shaped article as a diaphragm in an electrolytic cell. In this latter case an alkaline solution having a concentration of alkali of at least 5 g/l, and preferably a concentration in the range 10 to 150 g/l is suitably used, and contact between the solution on the shaped article may suitably be effected for a time in the range 1 hour to 100 hours at a temperature in the range up to 100° C., preferably up to 90° C.

In a preferred process the irradiated shaped article is contacted with a liquid medium which is readily able to wet the shaped article, the shaped article is then contacted with a liquid alkaline solution, and the steps of contacting the shaped article with the liquid medium and with the liquid alkaline solution are repeated at least once.

The porous diaphragm produced in the process of the invention is particularly suitable for use in an electrolytic cell for the production of chlorine and aqueous alkali metal hydroxide solution by the electrolysis of aqueous alkali metal chloride solution. However it is not limited to use in such cells, and it may be used in electrolytic cells for the electrolysis of other electrolytes and in which a porous diaphragm is used. It may also be used in fuel cells.

The invention is illustrated by the following examples.

EXAMPLE 1

A 1 mm thick 18 cm diameter circular sheet of porous polytetrafluoroethylene having a microstructure of nodes interconnected by fibrils and having a porosity of 70% (Gore-Tex, W. L. Gore and Associates Inc) was clamped in a circular stainless steel frame and the frame and sheet were immersed in acetone and subjected to ultrasonic vibration for 10 minutes in order to clean the surface of the sheet. The sheet and frame were then removed from the acetone and the sheet was allowed to dry in air.

The sheet was then rolled into the form of a cylinder and placed in a thick-walled glass tube, the tube was evacuated to a pressure of $10^{-2}$ mm of mercury, and the tube and contents were irradiated with 2.2 M rads of $Co^{60}$ $\gamma$-rays at a dose rate of 0.44 M rads $hr^{-1}$.

10 minutes after completion of the irradiation gaseous ammonia was admitted to the tube at a pressure of 0.5 atmosphere, and the tube and contents were allowed to stand for 24 hours and were then heated to a temperature of 150° C. and held at this temperature for a period of 15 minutes, and the tube was then allowed to cool and air was admitted to the tube.

The sheet was then sprayed with an aqueous solution containing 2.5% by weight of a calcium perfluorooctane sulphonate salt, the sheet was allowed to dry, and was installed in an electrolytic cell comprising a mild steel mesh cathode and a titanium anode having a coating of a mixture of $RuO_2$ and $TiO_2$ (35:65 parts by weight). The anode-cathode gap was 6 mm and the sheet was positioned between the anode and cathode thus dividing the cell into separate anode and cathode compartments.

Initially, the anode compartment was filled with distilled water, after 2 hours the distilled water was replaced by a saturated aqueous sodium chloride solution (pH 9) and a hydrostatic head of 20 cm of the solution was applied. Liquor permeated through the diaphragm to fill the cathode chamber and after further 2 hours an electrical potential was applied across the cell.

After 3 days operation the cell was operating at a voltage of 3.16 volts, an anode current density of 2.5 Kamps $m^{-2}$ and an anolyte temperature of 88° C., and sodium hydroxide at a concentration of 138 g $l^{-1}$ was produced at a current efficiency of 88%. The permeability of the diaphragm was 0.089 $hr^{-1}$.

After 72 days operation the cell voltage was 3.34 volts, the anode current density was 2.5 Kamps $m^{-2}$, the current efficiency was 95%, the permeability of the diaphragm was 0.088 $hr^{-1}$, the sodium hydroxide concentration was 112 g/l, and the temperature was 82° C.

After 110 days operation the cell voltage was 3.26 volts, the anode current density was 2.5 Kamps $m^{-2}$, the current efficiency was 90%, the permeability of the diaphragm was 0.03 $hr^{-1}$, the sodium hydroxide concentration was 122 g/l, and the temperature was 80° C.

By way of comparison the above procedure was repeated except that the porous sheet was not subjected to irradiation with $\gamma$-rays and the sheet was not contacted with ammonia.

After 24 hours operation in the electrolytic cell the voltage was 2.93 volts, the current density was 2.0 Kamps $m^{-2}$, sodium hydroxide at a concentration of 170 g $l^{-1}$ was produced at a current efficiency of 83%, and the permeability of the diaphragm was 0.13 $hr^{-1}$. However, after 6 days of operation the voltage had risen to 3.5 volts and the permeability of the diaphragm had decreased to 0.03 $hr^{-1}$.

EXAMPLE 2

A 1 mm thick 18 cm diameter circular sheet of porous polytetrafluoroethylene as used in Example 1 was clamped in a circular stainless steel frame and the frame and sheet were immersed in acetone and subjected to ultasonic vibration for 30 minutes. The sheet was then allowed to dry in air, was removed from the frame, was washed for 12 hours in hot methanol in a continuous extraction apparatus, and was then dried in air.

The thus washed sheet was rolled into the form of a cylinder and placed in a thick-walled glass tube, the tube was evacuated to a pressure of $3\times10^{-2}$ mm of mercury, and the tube and contents were irradiated with 4.9 M Rads of $Co^{60}$ $\gamma$-rays at a dose rate of 0.3 M Rads $hr^{-1}$.

After irradiation the tube was re-evacuated to remove any volatile materials which may have been liberated during the irradiation, and gaseous ammonia at a pressure of 0.5 atmosphere was admitted to the tube and the tube and contents were allowed to stand for 24 hours. Thereafter, the tube and contents were heated at 150° C. for 15 minutes, allowed to cool, and air was admitted to the tube.

The sheet was then clamped in a stainless steel frame, immersed in methanol and subjected to ultrasonic vibration to wet the sheet, then immersed in a 10% aqueous sodium hydroxide solution, and finally the solution was heated to 85° C. and held at this temperature for 16 hours. The treatment of the sheet with methanol and sodium hydroxide solution was repeated twice after which the sheet, whilst still wet, was installed in an electrolytic cell as used in Example 1.

The anode compartment of the cell was filled with a 25% by weight aqueous sodium chloride solution which permeated through the diaphragm to fill the cathode compartment, and after 17 hours this latter solution in the anode compartment was replaced by saturated aqueous sodium chloride solution and a hydrostatic head of 20 cm of solution was applied.

The sodium chloride solution was electrolysed following the procedure described in Example 1. The results of electrolysis were as shown in the following table, Table 1.

TABLE I

| Days operation | Voltage volts | Anode current density Kamp $m^{-2}$ | Permeability of diaphragm $hr^{-1}$ | Temp °C. | NaOH concn $g\ l^{-1}$ | Current efficiency % |
|---|---|---|---|---|---|---|
| 2 | 3.31 | 2.5 | 0.160 | 80 | 134 | 86.7 |
| 99 | 3.40 | 2.5 | 0.072 | 75 | 122 | 93.5 |
| 140 | 3.46 | 2.5 | 0.055 | 84 | 133 | 92.6 |
| 240 | 3.40 | 2.5 | 0.041 | 84 | 129.5 | 94.1 |
| 330 | 3.43 | 2.5 | 0.037 | 84 | 143.5 | 92.4 |

EXAMPLE 3

A 1 mm thick 18 cm diameter circular sheet of porous polytetrafluoroethylene as used in Example 1 was cleaned in acetone following the procedure described in Example 1, and the sheet was then washed with methanol and allowed to dry.

The sheet was then rolled into the form of a cylinder and placed in a thick-walled glass tube, the tube was evacuated to a pressure of $10^{-2}$ mm of mercury, and the tube and contents were irradiated with 5.0 M rads of $CO^{60}$ $\beta$-rays at a dose rate of 0.25 M rads $hr^{-1}$.

10 minutes after completion of the irradiation gaseous phosgene was admitted to the tube at a pressure of 0.5 atmosphere, and the tube and contents were allowed to stand for 24 hours and were then heated to a temperature of 150° C. and held at this temperature for a period of 15 minutes, and the tube was then allowed to cool and air was admitted to the tube.

The sheet was then treated with methanol and with 10% aqueous sodium hydroxide solution, and thereafter the sheet was installed in an electrolytic cell and aqueous sodium chloride solution was electrolysed following the procedure described in Example 2.

The results of the electrolysis were as shown in the following table, Table II.

TABLE II

| Days operation | Voltage volts | Anode current density Kamp $m^{-2}$ | Permeability of diaphragm $hr^{-1}$ | Temp °C. | NaOH concn $g\ l^{-1}$ | Current efficiency % |
|---|---|---|---|---|---|---|
| 5 | 3.00 | 2.5 | 0.204 | 84 | 110 | 90.4 |
| 20 | 3.03 | 2.5 | 0.052 | 84 | 118 | 90.1 |
| 47 | 3.23 | 2.5 | 0.051 | 84 | 119 | 88.2 |

TABLE III

| Days operation | Voltage volts | Anode current density Kamp $m^{-2}$ | Permeability of diaphragm $hr^{-1}$ | Temp °C. | NaOH concn $g\ l^{-1}$ | Current efficiency % |
|---|---|---|---|---|---|---|
| 6 | 3.07 | 2.5 | 0.054 | 87 | 125 | 89.1 |
| 13 | 3.10 | 2.5 | 0.054 | 83 | 123 | 92 |
| 30 | 3.28 | 2.5 | 0.058 | 88 | 131 | 93.6 |

EXAMPLE 4

A sheet of porous polytetrafluoroethylene was irradiated and treated with phosgene following the procedure of Example 3 except that the sheet was irradiated with 2 M Rads of $Co^{\alpha}$ $\gamma$-rays at a dose rate of 0.25 M Rads $hr^{-1}$. The sheet was then treated with methanol and aqueous sodium hydroxide solution and installed in an electrolytic cell, and aqueous sodium chloride solution was electrolysed following the procedure described in Example 2. The results of the electrolysis were as shown in Table III.

EXAMPLE 5

A 1 mm thick 18 cm diameter sheet of porous polytetrafluoroethylene was cleaned following the procedure described in Example 1.

The sheet was then rolled into the form of a cylinder and placed in a thick-walled glass tube, the tube was evacuated to a pressure of $10^{-2}$ mm of mercury, carbon monoxide at a pressure of 1 atmosphere was introduced into the tube, and the tube and contents were irradiated with 0.5 M Rad of $Co^{60}$ $\gamma$-rays at a dose rate of 0.1 M Rads $hr^{-1}$.

The porous sheet was then removed from the tube, sprayed with an aqueous solution of 2.5% by weight calcium perfluorooctane sulphonate salt, and installed in an electrolytic cell, and aqueous sodium chloride solution was electrolysed, all following the procedure described in Example 1.

The results of the electrolysis were as shown in the following table, Table IV.

TABLE IV

| Days operation | Voltage volts | Anode current density Kamp $m^{-2}$ | Permeability of diaphragm $hr^{-1}$ | Temp °C. | NaOH concn $g\ l^{-1}$ | Current efficiency % |
|---|---|---|---|---|---|---|
| 3 | 3.12 | 2.5 | 0.056 | 86 | 128 | 82.4 |
| 21 | 3.10 | 2.5 | 0.054 | 86 | 123.6 | 82.4 |
| 50 | 3.14 | 2.5 | 0.053 | 83 | 134 | 83.0 |

I claim:

1. A process for the production of a porous diaphragm suitable for use in an electrolytic cell characterised in that the process comprises irradiating a porous shaped article of an organic polymeric material with high energy radiation, the irradiation being effected in the presence of, or the irradiated shaped article being subsequently contacted with, a reactant selected from ammonia, carbon monoxide or phosgene.

2. A process as claimed in claim 1 characterised in that the porous shaped article is in the form of a sheet.

3. A process as claimed in claim 1 characterised in that the porous shaped article has a microstructure of nodes interconnected by fibrils.

4. A process as in claim 1, 2 or 3 characterised in that the organic polymeric material is fluorine-containing polymeric material.

5. A process as in claim 1, 2 or 3 characterised in that the porous shaped article has a porosity in the range 40% to 90%.

6. A process as in claim 1 characterised in that the porous shaped article is irradiated with $\gamma$-rays.

7. A process as in claim 6 characterised in that the porous shaped article is irradiated with at least 0.5 M Rad of radiation.

8. A process as in claim 1, 2 or 3 characterised in that irradiation is effected in the substantial absence of oxygen.

9. A process as in claim 1, 2 or 3 characterised in that irradiation is effected in a vacuum and in that the thus irradiated shaped article is subsequently contacted with a reactant selected from ammonia, carbon monoxide and phosgene.

10. A process as in claim 1, 2 or 3 characterised in that the reactant is in gaseous form.

11. A process as in claim 1, 2 or 3 characterised in that after irradiation of the porous shaped article and contact with reactant has been effected the article is heated in the presence of the reactant.

12. A process as in claim 1 characterised in that the porous shaped article is subsequently contacted with a liquid alkaline solution.

13. A process as claimed in claim 12 characterised in that the liquid alkaline solution is an aqueous solution of an alkali metal hydroxide.

14. A porous diaphragm produced by a process as in claim 1, 2, or 3.

* * * * *